US011267026B2

(12) United States Patent
Sauerwein

(10) Patent No.: US 11,267,026 B2
(45) Date of Patent: Mar. 8, 2022

(54) SHEET METAL ROLLING MACHINE FOR FORMING COMPLEX SHAPES

(71) Applicant: Metal Design Systems, Inc., Cedar Rapids, IA (US)

(72) Inventor: David A. Sauerwein, Belleville, IL (US)

(73) Assignee: METAL DESIGN SYSTEMS, INC., Cedar Rapids, IA (US)

( * ) Notice: Subject to any disclaimer, the term of this patent is extended or adjusted under 35 U.S.C. 154(b) by 219 days.

(21) Appl. No.: 16/442,914

(22) Filed: Jun. 17, 2019

(65) Prior Publication Data

US 2020/0391262 A1 Dec. 17, 2020

(51) Int. Cl.

| | |
|---|---|
| ***B21B 13/02*** | (2006.01) |
| ***B21B 35/14*** | (2006.01) |
| ***B21B 1/22*** | (2006.01) |

(52) U.S. Cl.

CPC ..... *B21B 13/02* (2013.01); *B21B 1/22* (2013.01); *B21B 35/14* (2013.01)

(58) Field of Classification Search

CPC ... B21D 3/04; B21D 3/05; B21D 5/06; B21D 5/08; B21D 5/10; B21D 5/14; B21B 1/20; B21B 1/22; B21B 13/02; B21B 13/008; B21B 35/14; B21B 2203/187; B21B 31/16; B21B 37/72; B21B 13/001

See application file for complete search history.

(56) References Cited

U.S. PATENT DOCUMENTS

| | | | | |
|---|---|---|---|---|
| 2,843,178 A | | 7/1958 | Nighthart | |
| 3,081,651 A | * | 3/1963 | Roberts | B21B 37/28 72/9.1 |
| 3,557,594 A | | 1/1971 | Pease et al. | |
| 3,623,349 A | | 11/1971 | Hausler et al. | |
| 4,195,509 A | * | 4/1980 | Herburg | B21D 5/14 72/167 |
| 4,735,076 A | | 4/1988 | Zeugin et al. | |
| 6,655,182 B2 | * | 12/2003 | Mattsson | B21D 5/14 72/110 |

FOREIGN PATENT DOCUMENTS

| | | | | |
|---|---|---|---|---|
| DE | 3940984 A1 | | 6/1991 | |
| EP | 0204290 A2 | | 12/1986 | |
| JP | 05146802 A | * | 6/1993 | B21B 1/38 |

OTHER PUBLICATIONS

International Search Report and Written Opinion dated Oct. 3, 2019 for counterpart International Application No. PCT/US2019/037451.

* cited by examiner

*Primary Examiner* — Teresa M Ekiert
(74) *Attorney, Agent, or Firm* — Shuttleworth & Ingersoll, PLC; Jason Sytsma

(57) ABSTRACT

First drive roller and second drive roller are coplanar and adjustable about an axis to increase or decrease the distance between the same to accommodate varying thicknesses in material. A first shaping roller and a second shaping roller that are also coplanar are provided with ends tiltable on an axis with respect to each other. While the first drive roller and the second drive roller remain parallel with respect to each other, the first shaping roller and the second shaping roller are not constrained in a parallel orientation, but rather can tilt with respect to each other to form sheet metal with complex shapes.

18 Claims, 4 Drawing Sheets

SHEET METAL ROLLING MACHINE FOR FORMING COMPLEX SHAPES

TECHNICAL FIELD

This disclosure relates to a machine and process for forming three dimensional shapes from sheet metal.

BACKGROUND INFORMATION

Machines for shaping sheet metal using three or four rolls are known. One or two driven rolls move the workpiece until on passing through one or two adjustable bending rolls it has assumed the desired shape. Generally these machines have a pair of drive rolls (often referred to as pinch rolls) and one shaping roll in the back if it is a three-roll machine. Four-roll machines have a shaping roller in the front if the drive rolls and a shaping roll after the drive rolls. The drive rollers feed the sheet metal through the shaping roller, which is generally adjustable in limited manners to provide the desired shapes.

While there have been many advances in machines of this type, what all of these machines lack is the ability to form complex shapes. Accordingly, there is a need for an improved sheet metal forming machine and methods for forming complex shapes.

SUMMARY

In accordance with one aspect of the present invention, a forming machine for forming complex shapes is disclosed. The machine can comprise a first drive roller and a second drive roller to feed a material through the machine for shaping. First drive roller and second drive roller can be coplanar on an x-z plane, fixed on the x-axis, and adjustable about the z-axis to increase or decrease the distance between the same to accommodate varying thicknesses in material. A first shaping roller and a second shaping roller that are also coplanar on the x-z plane and fixed on the x-axis are provided with ends tiltable on the z-axis with respect to each other. While the first drive roller and the second drive roller remain parallel with respect to each other, the first shaping roller and the second shaping roller are not constrained in a parallel orientation, but rather can tilt with respect to each other.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
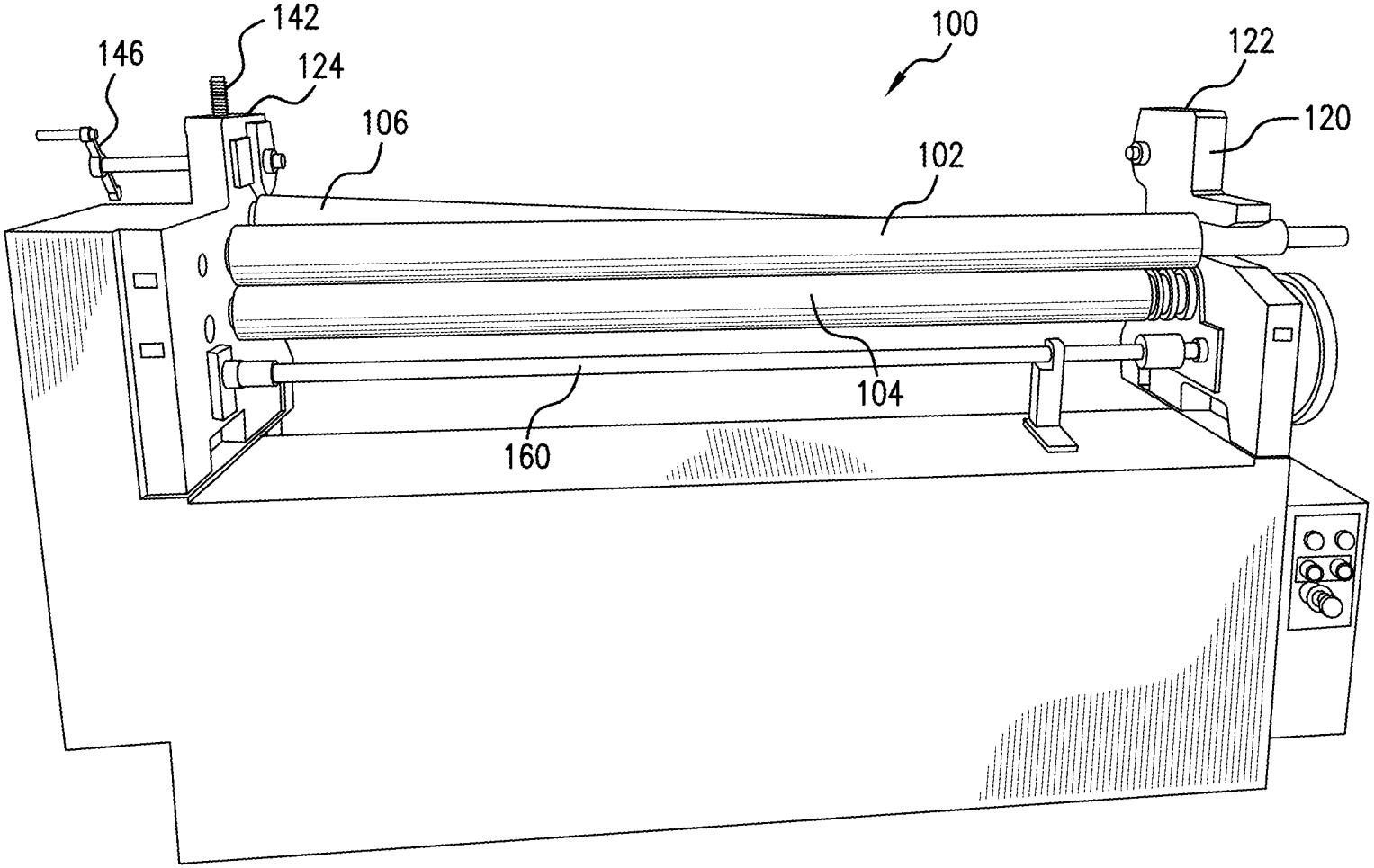
FIG. 1 is a front perspective view of a sheet metal forming machine according to this disclosure.
Figure 2:
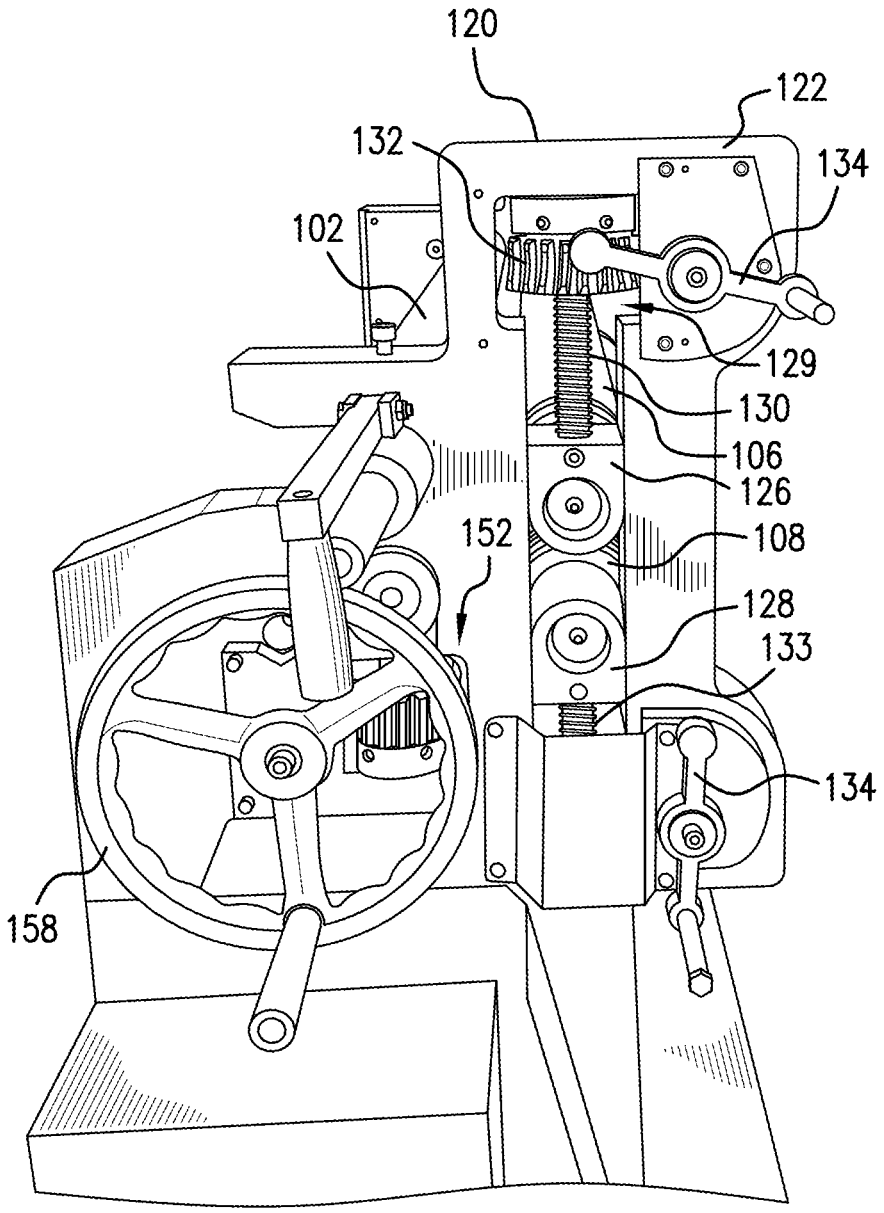
FIG. 2 is a right-side view of the machine of FIG. 1.
Figure 3:
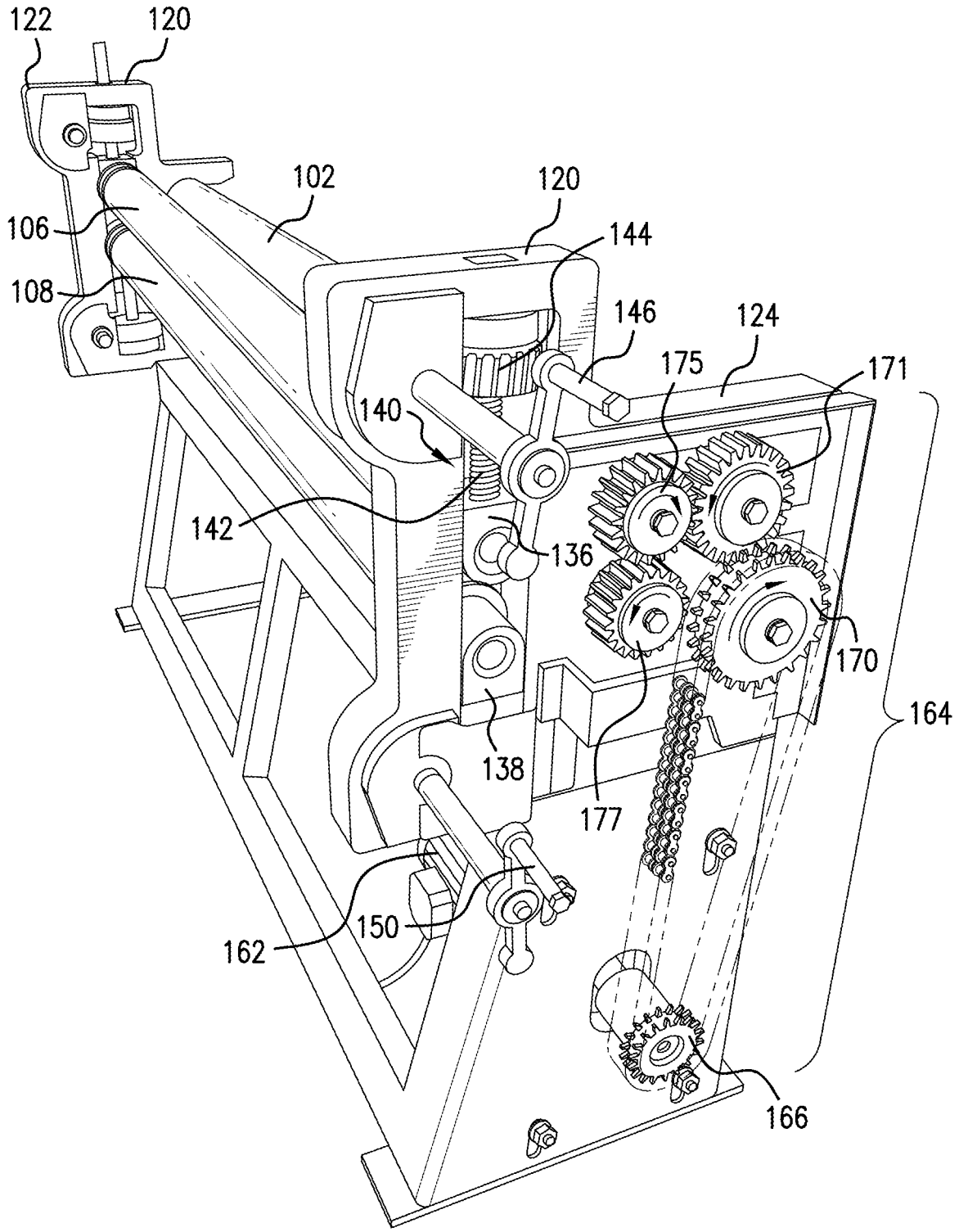
FIG. 3 is a left-side view of the machine of FIG. 1.

Referring to FIGS. 1-3, shown is a forming machine 100 for forming complex shapes. Forming machine 100 comprises generally of a first drive roller 102, a second drive roller 104, a first shaping roller 106 and a second shaping roller 108. First drive roller 102 and second drive roller 104 are positioned co-planar and parallel with respect to each other about an x-z plane with an adjustable spacing with respect to each other on a z-axis to accommodate material of varying thicknesses. First shaping roller 106 and second shaping roller 108 are similarly co-planar about the x-z plane but with each end independently adjustable about the z-axis. This novel arrangement of first shaping roller 106 and second shaping roller 108 allows for the forming of complex geometrical shapes or waves in the material.

More specifically, first drive roller 102 and second drive roller 104 are independently driven in opposite directions of rotation to feed a material 200 through forming machine 100 for shaping. First drive roller 102 and second drive roller 104 are coplanar on the x-z plane and fixed on the x-axis parallel to each other. One or both of the first drive roller 102 and second drive roller 104 can be adjusted about the z-axis to increase or decrease the distance between the same to accommodate varying thicknesses in material 200.

First shaping roller 106 is tiltable with one end higher than the other end and second shaping roller 108 is tiltable with one end higher than the other end. This means that each end of both the first shaping roller 106 and second shaping roller 108 is adjustable about the z-axis to raise and lower the respective ends with respect to each other. Unlike first drive roller 102 and second drive roller 104, first shaping roller 106 and second shaping roller 108 are not constrained parallel with respect to each other. Both first shaping roller 106 and second shaping roller 108 are also coplanar on the x-z plane and fixed on the x-axis.

Forming machine 100 further comprises of a frame 120 for holding first drive roller 102, second drive roller 104, first shaping roller 106 and second shaping roller 108 in position. Frame 120 can comprise a right side member 122 and a left side member 124. FIG. 2 is a right-side view of forming machine 100 that shows right side member 122. Right side member 122 comprises of a machined out area for receiving the bearings that hold the rollers. A pillow block bearing 126 is positioned in the machined out area to locate on the x-axis the right side end of first shaping roller 106. Another pillow block bearing 128 is positioned in the machined out area below pillow block bearing 126 to locate on the x-axis the right side end of second shaping roller 108.

Pillow block bearing 126 is attached to an elevation system 129 to raise and lower pillow block bearing 126 about the z-axis. Elevation system 129 can comprise a threaded shaft 130 attached at one end to pillow block bearing 126 and at the other end fed through a slave gear 132. Slave gear 132 is circumscribed by teeth so that it can be rotate by a drive gear attached to a handle 134. Rotation of handle 134 rotates the drive gear which rotates slave gear 132 to cause threaded shaft 130 to be drawn up or down based on the direction of rotation.

Similarly, pillow block bearing 128 is attached to elevation system 134 to raise and lower pillow block bearing 128 about the z-axis. Elevation system 134 can comprise a threaded shaft 133 attached at one end to pillow block bearing 128 and at the other end fed through a slave gear that is connected to a drive gear in the manner described above. A handle 134 is combined to the drive gear to rotate the drive gear in the manner described above to raise and lower pillow block bearing 128.

FIG. 3 shows the left side of forming machine 100. One skilled in the art will recognize that the left side of forming machine 100 is configured the same way with the same components, namely left side member 124 comprising a machined out area for receiving a pillow block bearing 136 is positioned in the machined out area to locate on the x-axis the left side end of first shaping roller 106. Another pillow block bearing 138 is positioned in the machined out area below pillow block bearing 136 to locate on the x-axis the left side end of second shaping roller 108. Pillow block bearing 136 is attached to an elevation system 140 to raise and lower pillow block bearing 136 about the z-axis. Elevation system 140 can comprise a threaded shaft 142 attached at one end to pillow block bearing 136 and at the other end fed through a slave gear 144. Slave gear 144 is circumscribed by teeth so that it can be rotate by a drive gear attached to a handle 146. Rotation of handle 146 rotates the drive gear which rotates slave gear 144 to cause threaded shaft 142 to be drawn up or down based on the direction of rotation.

Similarly, pillow block bearing 138 is attached to elevation system 140 to raise and lower pillow block bearing 138 about the z-axis. Elevation system 140 can comprise a threaded shaft attached at one end to pillow block bearing 138 and at the other end fed through a slave gear that is connected to a drive gear in the manner described above. A handle 150 is combined to the drive gear to rotate the drive gear in the manner described above to raise and lower pillow block bearing 138.

One or both of first drive roller 102 and second drive roller 104 can be moved upward and downward on the z-axis in a manner similar to the above-described first shaping roller 106 and second shaping roller 108. In the illustrated embodiment, second drive roller 104 is combined to an elevation system 152. The right-side end of second drive roller 104 is connected to a pillow block bearing 154. A threaded shaft 156 is attached at one end to pillow block bearing 154 and at the other end fed through a slave gear with circumscribed teeth coupled to a drive gear that is attached to a handle 158. Handle 158 is also combined to a cross rod 160 (shown in FIG. 1) that extends across the machine to a corresponding elevation system in left side member 124 to simultaneously raise/lower the left-side end of second drive roller 104. In this regard, rotation of handle 158 rotates the drive gear which rotates slave gear to cause threaded shaft 156 to be drawn up or down based on the direction of rotation with similar action occurring simultaneously on the other side via rotation of cross rod 160.

Both first drive roller 102 and second drive roller 104 are driven. FIG. 3 shows a motor 162 coupled to a drive system 164 to drive first drive roller 102 one direction and second drive roller 104 in the counter rotational direction. Drive system 164 comprises of a first gear 166 coupled to the shaft of motor 162. A chain 168 couples first gear 166 to a second gear 170. A third gear 171 couples second gear 170 to a fourth gear 175 that is combined to first drive roller 102. Fourth gear 175 is coupled to a fifth gear 177, which is combined to second drive roller 104. This configuration drives first drive roller 102 one direction and second drive roller 104 in the counter rotational direction.

Forming machine 100 can be used to form complex three dimensional shapes. One end of either one or both of first shaping roller 106 and second shaping roller 108 can be raised and the other end is lowered. This effectively applies an upward bending force on one edge of the sheet and a downward bending force on the other edge of the sheet and no bending force in the middle of the sheet. First shaping roller 106 and second shaping roller 108 can also be raised and lowered at unequal rates so the upward and downward bending forces are not equal in opposite directions to move the unformed portion of the sheet off center. This arrangement applies varying bending forces along the width of the sheet as it goes through first shaping roller 106 and second shaping roller 108.

Figure 4:
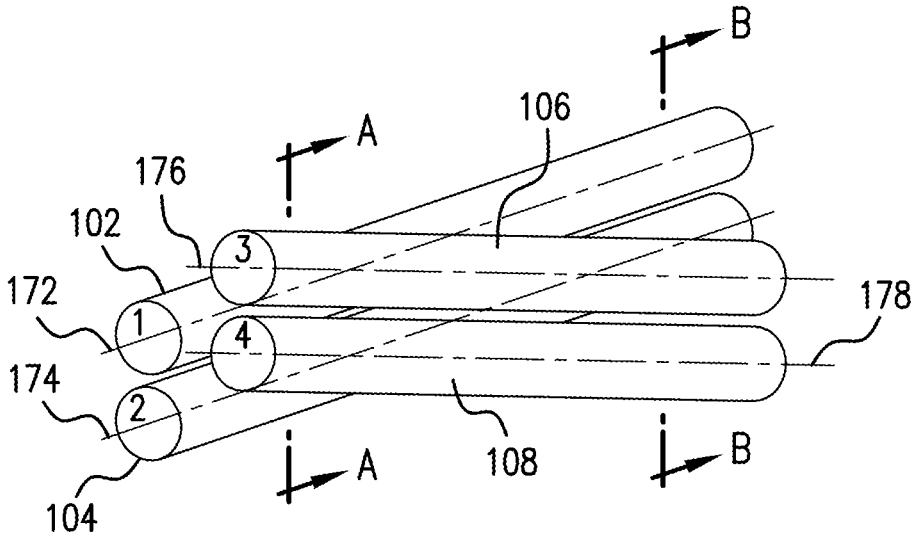
FIG. 4 shows the rollers in the forming machine of FIG. 1 separated from the rest of the forming machine.

FIG. 4 shows first drive roller 102, second drive roller 104, first shaping roller 106, and second shaping roller 108 separated from the rest of forming machine 100 to better illustrate their maneuverability. Each of the rollers rotates about a corresponding axis. First drive roller 102 rotates about axis 172, second drive roller 104 rotates about axis 174, first shaping roller 106 rotates about axis 176, and second shaping roller 108 rotates about axis 178. As shown from the illustration, axis 172 and axis 174 are positioned co-planar and parallel with respect to each other about an x-z plane with an adjustable spacing with respect to each other on a z-axis to accommodate material of varying thicknesses. Axis 176 and axis 178 are similarly co-planar about the x-z plane but with each end independently adjustable about the z-axis. This novel arrangement of first shaping roller 106 and second shaping roller 108 allows for the forming of complex geometrical shapes or waves in the material.

Figure 5:
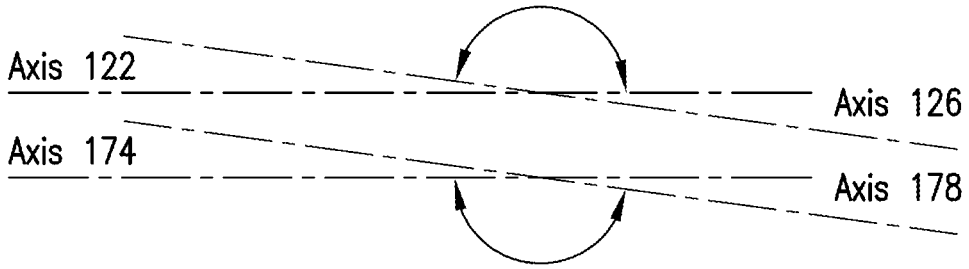
FIG. 5 is an illustration of the adjustable nature of the axes of the rollers of FIG. 4.

FIG. 5 is an illustration of the adjustable nature of the axes of the rollers of FIG. 4. This illustration shows that axis 176 and axis 178 can each be tilted on each end with respect to axis 172 and axis 174 that remain parallel with respect to the ground plane.

Figure 6:
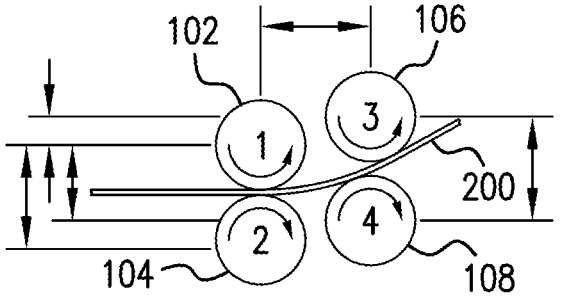
FIG. 6 is an illustration of forming material from the perspective A-A of the right side of the forming machine.
Figure 7:
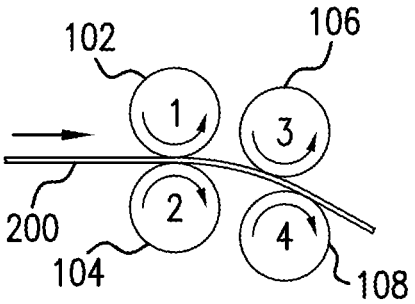
FIG. 7 is an illustration of forming the same material from the perspective B-B of the left side of the forming machine.

FIGS. 6 and 7 are illustrations taken from the perspective of A-A and B-B in FIG. 4, respectively to show how material 200 can be formed with complex waves. As seen in these figures, as the right side of material 200 is bent upward with respect to the ground plane, material 200 can be bent downward with respect to the ground plane. This forms material 200 with a complex undulating wave across material 200.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

I claim:

1. An apparatus for shaping material, the apparatus comprising:

a first drive roller;

a second drive roller coplanar on a first x-z plane with the first drive roller;

a first shaping roller tiltable with one end higher than the other end; and a second shaping roller tiltable independent from the first shaping roller with one end higher than the other end and coplanar on a second x-z plane with the first shaping roller, wherein the first x-z plane and the second x-z plane are separated on a y-axis.

2. The apparatus of claim 1, wherein each of the one end and the other end of the first shaping roller is adjustable about a z-axis with the first shaping roller and the second shaping roller coplanar on a second x-z plane.

3. The apparatus of claim 2, wherein each of the one end and the other end of the second shaping roller is adjustable about the z-axis and adjustable with respect to the first shaping roller.

4. The apparatus of claim 3, wherein the first drive roller and the second drive roller are coplanar on the first x-z plane.

5. The apparatus of claim 4, wherein the first drive roller and the second drive roller are adjustable with respect to each other about the z-axis.

6. The apparatus of claim 5, wherein the first shaping roller and the second shaping roller are fixed about the x-axis.

7. The apparatus of claim 6, wherein the first drive roller and the second drive roller are fixed about the x-axis.

8. The apparatus of claim 1, and further comprising a first elevation system combined to one end of the first shaping roller and a second elevation system combined to the other end of the first shaping roller to raise and lower the respective ends of the first shaping roller.

9. The apparatus of claim 8, and further comprising a third elevation system combined to one end of the second shaping roller and a fourth elevation system combined to the other end of the second shaping roller to raise and lower the respective ends of the second shaping roller.

10. The apparatus of claim 8, wherein the first elevation system further comprises of a first member with a machined out area to provide a path of travel for a first pillow block bearing that receives the one end of the first shaping roller.

11. The apparatus of claim 10, wherein the first elevation system further comprises of a threaded shaft combined at one end to the first pillow block bearing and at the other end to a slave gear such that rotation of the slave gear draws up the threaded shaft to raise the first pillow block bearing.

12. The apparatus of claim 11, wherein the first elevation system further comprises of a handle for rotation by a user combined to a drive gear that meshes with the slave gear so that rotation of the handle causes rotation of the slave gear to raise the first pillow block bearing.

13. The apparatus of claim 12, wherein the second elevation system further comprises of a second member with a machined out area to provide a path of travel for a second pillow block bearing that receives the other end of the first shaping roller, a threaded shaft combined at one end to the second pillow block bearing and at the other end to a slave gear such that rotation of the slave gear draws up the threaded shaft to raise the first pillow block bearing, and a handle for rotation by a user combined to a drive gear that meshes with the slave gear so that rotation of the handle causes rotation of the slave gear to raise the first pillow block bearing.

14. An apparatus for shaping metal, the apparatus comprising:

a first drive roller;

a second drive roller coplanar with the first drive roller on a first x-z plane;

a first shaping roller tiltable with each end independently adjustable about a z-axis; and a second shaping roller tiltable independent from the first shaping roller and with each end independently adjustable about the z-axis and coplanar on a second x-z plane with the first shaping roller, wherein the first x-z plane and the second x-z plane are separated on a y-axis.

15. The apparatus of claim 14, wherein the first drive roller and the second drive roller are coplanar on the first x-z plane.

16. The apparatus of claim 14, wherein the first shaping roller and the second shaping roller are fixed about the x-axis.

17. The apparatus of claim 14, wherein the first drive roller and the second drive roller are separated from the first shaping roller and the second shaping roller on the y-axis.

18. The apparatus of claim 14, and further comprising:

a first elevation system combined to one end of the first shaping roller;

a second elevation system combined to the other end of the first shaping roller to raise and lower the respective ends of the first shaping roller;

a third elevation system combined to one end of the second shaping roller; and a fourth elevation system combined to the other end of the second shaping roller to raise and lower the respective ends of the second shaping roller;

wherein the first elevation system further comprises of a first member with a machined out area to provide a path of travel for a first pillow block bearing that receives the one end of the first shaping roller, wherein the first elevation system further comprises of a handle for rotation by a user combined to a drive gear of the first elevation system that meshes with a slave gear of the first elevation system so that rotation of the handle causes rotation of the slave gear of the first elevation system to raise the first pillow block bearing;

wherein the second elevation system further comprises of a second member with a machined out area to provide a path of travel for a second pillow block bearing that receives the other end of the first shaping roller, a threaded shaft combined at one end to the second pillow block bearing and at the other end to a slave gear of the second elevation system such that rotation of the slave gear of the second elevation system draws up the threaded shaft to raise the first pillow block bearing, and a handle for rotation by a user combined to a drive gear of the second elevation system that meshes with the slave gear so that rotation of the handle causes rotation of the slave gear to raise the first pillow block bearing.

* * * * *